United States Patent [19]

Langlois et al.

[11] Patent Number: 4,986,551

[45] Date of Patent: Jan. 22, 1991

[54] PORTABLE GOLF PRACTICE SWING ASSEMBLY

[76] Inventors: Jean C. Langlois, 7515 Charmant Dr., #1401, San Diego, Calif. 02122; Gary Dubie, 9823 Pacific Heights Blvd., #T, San Diego, Calif. 92121; Aleksandar Ratajac, 1333 Thomas Ave., Apt. 16, San Diego, Calif. 92109

[21] Appl. No.: 519,745

[22] Filed: May 7, 1990

[51] Int. Cl.[5] ..... A63B 69/36

[52] U.S. Cl. ..... 273/182 R; 273/58 C; 273/200 R; 273/396

[58] Field of Search ..... 273/182 R, 182 A, 200 R, 273/200 B, 58 C, 394, 396

[56] References Cited

U.S. PATENT DOCUMENTS

| | | | |
|---|---|---|---|
| 1,566,945 | 12/1925 | Winkley | 273/200 R X |
| 2,081,054 | 5/1937 | Mitchell | 273/200 R |
| 2,331,237 | 10/1943 | Schaefer | 273/182 R |
| 3,122,369 | 2/1964 | Windall | 273/200 R X |
| 3,197,208 | 7/1965 | Makar | 273/184 R X |
| 3,494,621 | 2/1970 | Windall | 273/200 R |
| 4,095,798 | 6/1978 | Marple | 273/200 R |

*Primary Examiner*—William H. Grieb
*Attorney, Agent, or Firm*—Charles C. Logan, II

[57] ABSTRACT

A portable golf practice swing assembly having a vertically oriented four sided frame assembly having a net stretched between its sides and secured thereto. The bottom of the assembly has laterally spaced attachment legs that are secured to the forward end of laterally spaces side frame members. The other ends of the frame members are secured to a golf ball support structure positioned a predetermined distance in front of the assembly. It has a tee upon which is mounted a golf ball. Secured to the front end of the ball is a first restraint line whose forward end is connected at a Y connection point to a pair of safety lines whose front ends are secured to the respective laterally spaced side frame members of the assembly. A second restraint line is connected to the rear of the ball and it passes upwardly about a first pulley mounted adjacent the top end of a support arm secured to the rear of the ball support panel, then passes around a second pulley mounted on the support arm and then forwardly around a third pulley after which itis attached by a hook on its forward end to one of several apertures in one the base frame members. At least part of the second restraint line is formed of an elastic shock cord. The ball can thus be driven into the net frame assembly and the shock cord will return it to a position adjacent the tee.

9 Claims, 2 Drawing Sheets

PORTABLE GOLF PRACTICE SWING ASSEMBLY

BACKGROUND OF THE INVENTION

The invention relates to golf and more specifically to a collapsible portable golf practice swing assembly.

Presently most golfers practice their golf swing by going to a driving range and hitting buckets of balls. Usually the more balls of golfer hits, the smoother and more consistent his swing becomes. Therefore in order to improve or maintain a golf swing it is necessary to practice the swing as often as possible. Going to the local practice range can be inconvenient or time consuming if one of pressed for time.

Various attempts have been made to design and manufacture golf practice swing assemblies that can be used for instructional purpose or by golfers in their own backyard. Several of these are large and cumbersome and difficult to setup and move.

It is an object of the invention to provide a novel portable golf practice e swing assembly that is easily assembled and disassembled.

It is a another object of the invention to provide a novel portable golf practice swing assembly that has a ball whose travel is restricted in a forward direction and which has an elastic shock cord restraining line attached to its rear end for returning it to its original position.

It is a further object of the invention to provide a novel portable practice swing assembly that has been designed with safety lines connected to the front of the golf ball to insure that persons standing near the person swinging a golf club or near the sides of the net from assembly cannot be struck by the ball on its forward or return flight.

It is an additional object of the the invention to provide a novel portable golf practice swing assembly that is economical to manufacture and market.

SUMMARY OF THE INVENTION

Applicant's novel portable golf practice assembly has been designed to that it is made of components that are easily and quickly assembled and disassembled. Many of these components are tubular and are made of lightweight material. Bolts and nuts are primarily used for securing the various components together. Since the portable golf practice swing assembly is collapsible, it can be stored and carried in a small container.

The portable golf practice assembly has a net frame assembly having four sides and it generally has a square configuration. A net extends between the four sides of the net frame assembly and it is secured thereto. A vertically oriented cloth target strip is positioned intermediate the lateral sides of the net frame assembly and it extends from the bottom edge to its top edge. When the practice golf ball strikes the cloth target strip on the front of the net a distinct sound is emitted that tells the golfer he has hit the shot down the middle. Shots to the left or right of the target strip produce a muffled sound, if any at all. Attachment legs extend forwardly from the bottom ends of the respective side frame members.

Spaced a predetermined distance in front of the net frame assembly is the golf ball support structure. It consists of a golf ball support panel to which is attached the bottom end of a flexible tubular member utilized as a golf tee. A plastic grass pad covers the golf ball support panel. It has an aperture through which the tubular golf ball tee passes.

The golf ball support panel is mounted on the top surface of the rear ends of laterally spaced elongated base frame members. These elongated base frame members each have a straight rear leg portion that flares outwardly at a predetermined angle from each other for their central portion and which are bent back in a longitudinal direction for their front leg portion that is removably secured to the respective attachment legs of the net frame assembly. When the forwardmost sets of bolts connecting the base frame members to the attachment legs of the net frame assembly are removed, the net frame assembly can be pivoted forwardly about the other sets o bolts to a collapsed horizontal position.

An elbow-shaped support arm has it horizontal leg portion secured laterally across the front ends of the respective elongate base frame members. The elbow-shaped support arm has an upwardly and forwardly angled leg portion that has a first pulley mounted adjacent its top end and a second pulley mounted at a predetermined distance down that leg. A golf ball mounted on the tee has a first restraint line connected to its front end and the restraint line has a Y-connection point at its forward end to which are attached safety lines that diverge from each other and have their front ends secured to the laterally spaced side frame members of the net frame assembly. These safety lines and the first restraint line are generally formed of a substantially nonelastic material such as nylon. Thus any golf balls that is hit outside of the right or left side frame member will have its travel distance restricted by one of the safety lines pivoting around its attachment point on one of the side frame members.

Attached to the rear of the practice golf ball is a second restraint line that is threaded upwardly around the top pulley on the elbow-shaped support arm and then rearwardly around a second pulley and then forwardly around a third pulley after which a hook member attached to its forward end can be detachably secured into one of the plurality of apertures formed in the elongated base frame members. By adjusting the position of the hook member in the different apertures the height of the bal can be adjusted so that the ball could be hit directly off the top surface of the plastic grass. This adjustment structure can also be used to compensate for the stretching of the shock cores. The second restraint line is a at least partially formed of an elastic shock cord material. The elbow-shaped support arm is reversible so that it may be adapted for either a right or left handed swinging golfer.

When the golfer strikes the practice golf ball and it travels into the net frame assembly, the net itself absorbs the forward momentum of the ball and the safety lines and first restraint line travel forwardly therealong and have little or no function at that time. Since the second restraint line is formed of an elastic shock cord material it is being stretched during its forward travel and once the ball strikes the net and has its force dissipated, the elastic properties of the shock cord will then draw the practice golf ball back to a position approximating that of the tee on the golf ball support panel.

DESCRIPTION OF THE PREFERRED EMBODIMENT

Figures 1, 3:
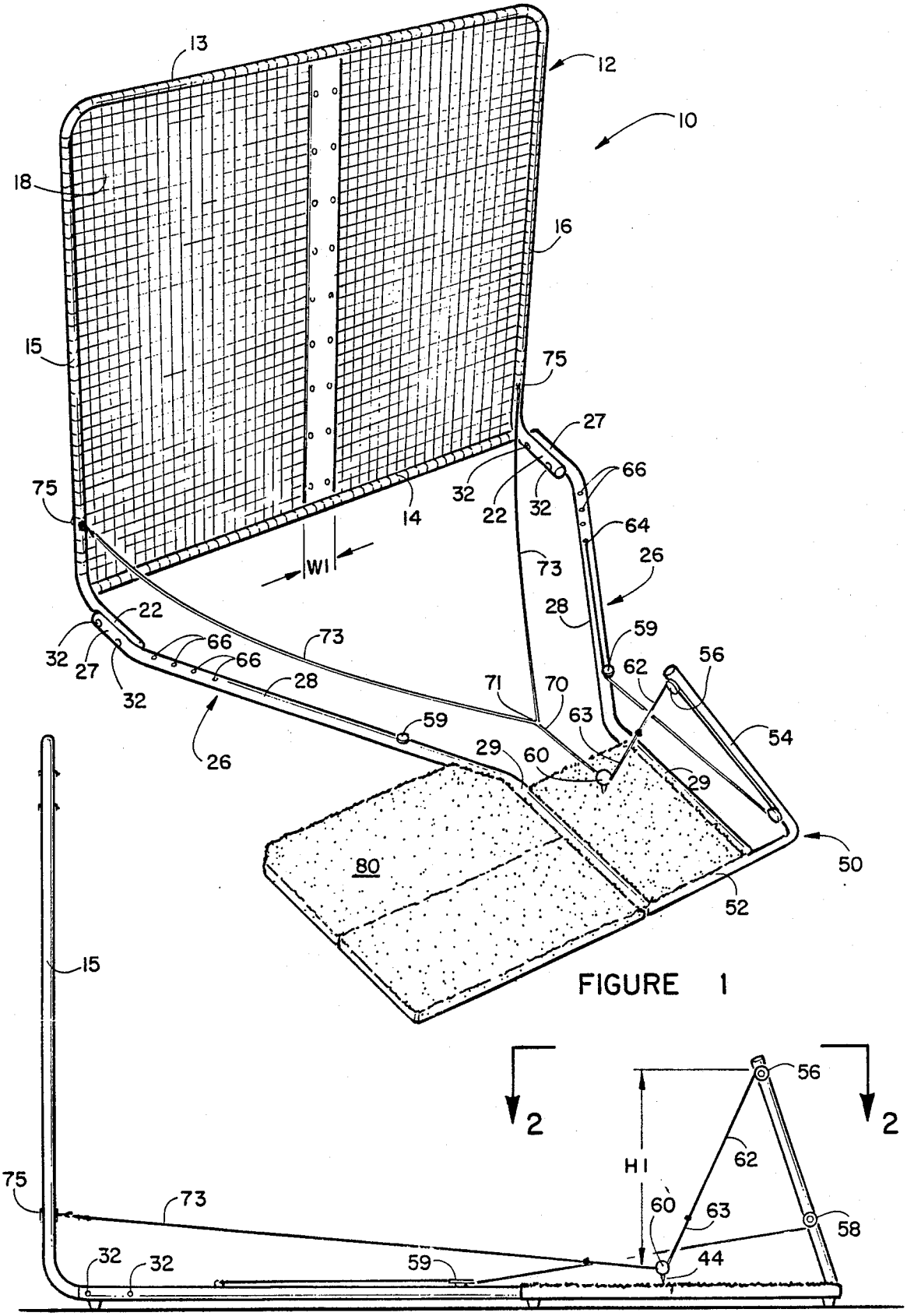
FIG. 1 is a front perspective view of the novel portable golf practice swing assembly.
FIG. 3 is a side elevation view of the novel portable golf practice swing assembly.
Figure 2:
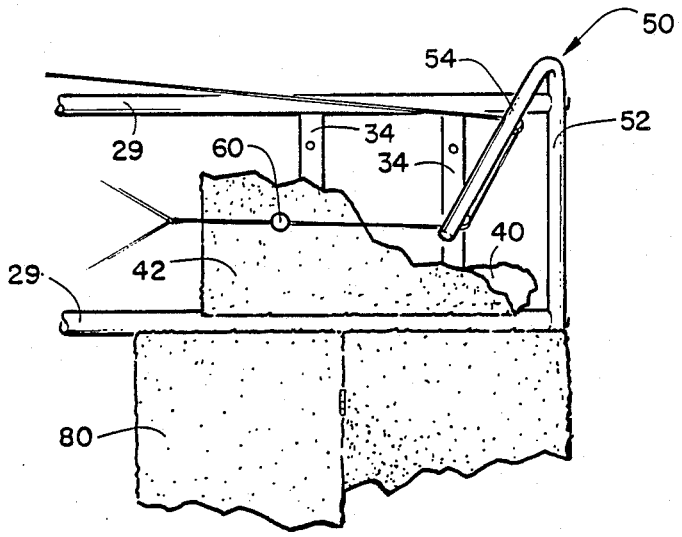
FIG. 2 is a top plan view of the support structure for the golf ball support panel.
Figure 4:
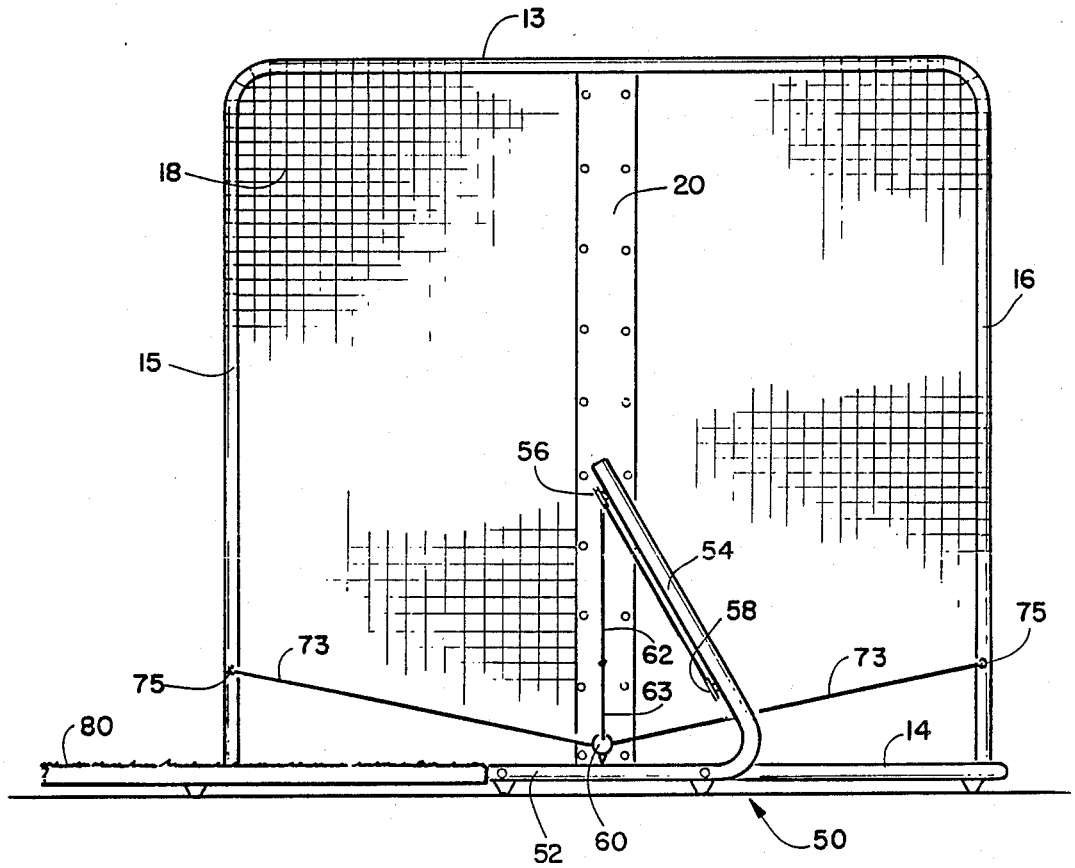
FIG. 4 is a front elevation view of the novel portable golf practice assembly.

Applicant's novel portable golf practice assembly will now be described by referring to FIGS. 1-14 4 of the drawings. The golf ball practice swing assembly is generally designated numeral 10.

Net frame assembly 12 has a top frame member 13, a bottom frame member 14, and laterally spaced side frame members 15 and 16. A net 18 extends between the four frame members and is secured thereto. A vertically oriented cloth target strip 20 having a width Wl is centrally positioned on net 18 and extends from its bottom end to its top end. Attachment legs 22 extend forwardly from the bottom end of the respective side frame members 15 and 16.

A pair of laterally spaced elongate base frame members 26 each have a front leg portion 27, a central portion 28, and a rear leg portion 29. The respective front leg portions 27 are connected by conventional nuts and bolts hardware 32 to the respective attachments legs 22 and by removing one of the sets of bolts 32 from each of the front leg portions, the net frame assembly can be pivoted forwardly about the other sets of bolts 32 to a collapsed horizontal position. A plurality of cross members 34 connect the rear leg portions 29. A golf ball support panel 40 is mounted on and secured to the respective cross members 34. A plastic grass pad 42 is mounted on support panel 40 and it has an aperture which allows a tubular golf tee 44 to pass upwardly therethrough. The bottom end of golf tee 44 is secured to support panel 40.

An elbow shaped support arm 50 has its horizontal oriented leg portion 52 secured to the front end of the respective rear leg portions 29. Upright oriented leg 54 of elbow-shaped support arm 50 extends upwardly and forwardly so that its top front end is spaced above the golf ball a predetermined height Hl. A pulley 56 is mounted adjacent the top end of leg 54 and its is oriented so that it lies in a vertical plane that is perpendicular to the front of the net frame assembly and this vertical plane also passes through the golf tee. A second pulley 58 is located adjacent the bottom end of leg 54 and a third pulley 59 is counted on central portion 28.

A golf ball 60 is mounted on golf ball tee 44. It has a restraint line 62 secured to it and restraint line 62 passes around pulley 56 and then rearwardly around pulley 58 and then forwardly around pulley 59. It has a hook 64 mounted on its forward end that is removably inserted into one of the apertures 66 formed in central portion 28. Restraint line 62 may have a portion 63 formed of nylon.

Golf ball tee 44 is positioned a predetermined distance Dl in front of net frame assembly 12. The front end of golf ball 60 has a restraint line 70 secured thereto and it extends forwardly to a Y-connection point 71. A pair of safety lines 73 are secured thereto and they have fasteners 75 that attach them to the respective side frame members 15 and 16.

A golfer platform 80 is removably positioned adjacent one of the rear leg portions 29 so that the golfer may stand thereon.

What is claimed is:

1. A portable golf practice swing assembly comprising:

an upright oriented primary frame assembly having a predetermined height, a predetermined width and a front end, a net stretched across said frame assembly and being secured thereto, said net functioning to absorb the foreword momentum and to restrict the forward travel of a golf ball that has been driven into the front end of said primary frame assembly;

a golf ball support structure positioned a predetermined distance from the front end of said primary frame assembly;

a secondary frame assembly connected between said primary frame assembly and said golf ball support structure, said secondary frame assembly functioning to keep said two structures rigidly positioned a predetermined distance from each other;

a golf ball having a front half and a rear half, said golf ball being freely positioned on said golf gall support structure;

a first restraint line having a front end and a rear end, said front end being secured to said golf ball and said rear end being secured to a fixed stationary structure, at least a portion of said first restraint line is formed of an elastic shock cord; and a second restraint line having a front end and a rear end, said front end being secured to said golf ball, said rear end being connected to tether means that is connected to said primary frame assembly.

2. A portable golf practice swing assembly as recited in claim 1 wherein said primary frame assembly has a bottom end and a pair of laterally spaced front attachment leg members are attached thereto for supporting said primary frame assembly in an upright position.

3. A portable golf practice swing assembly as recited in claim 1 wherein said primary frame assembly is formed from a pair of laterally spaced side frame members each having a top end and a bottom end, an elongated top frame member has it opposite ends connected to the respective top ends of said side frame members, an elongated bottom frame member has it opposite ends connected to the respective bottom ends of said side frame members.

4. A portable golf practice swing assembly as recited in claim 3 further comprising a vertically oriented cloth target strip having a predetermined width Wl that is attached to the front of said net at a position substantially equally spaced from its lateral edges, said target strip functions to emit a recognizable sound when it is hit by a golf ball to indicate if the golf ball has been driven straight down the middle.

5. A portable golf practice swing assembly as recited in claim 1 wherein said golf ball support comprises a vertically oriented flexible tubular member having a bottom end that is secured to a golf ball support panel.

6. A portable golf practice swing assembly as recited in claim 2 wherein said secondary frame assembly comprise a pair of laterally spaced elongated base frame members that each have an elongated straight central portion with an angularly oriented front leg portion at one end and an angularly oriented rear leg portion at its other end, said respective front leg portions being connected to said respective laterally spaced front attachment leg members, said respective rear leg portions being connected to the opposite lateral sides of said golf ball support structure.

7. A portable golf practice swing assembly as recited in claim 2 further comprising means for pivoting the net frame assembly forwardly about said attachment leg member to a collapsed horizontal position.

8. A portable golf practice swing assembly as recited in claim 1 further comprising a support arm having a top end and a bottom end, said bottom end being detachably connected to said secondary frame assembly, a first pulley is mounted on said support arm adjacent its top end and it is spaced a predetermined height Hl above said golf ball, a second pulley is mounted on said support arm at a position intermediate its ends, a third pulley is mounted on secondary frame assembly, said first restraint line as it comes from said golf ball sequentially passes around said first pulley and then around said second pulley and said third pulley and it has a hook attached to its other end that is removably captured in one of several apertures in said secondary' frame assembly.

9. A portable golf practice swing assembly as recited in claim 1 wherein said second restraint line is made of substantially non-stretchable material and said tether means are separate safety lines whose front ends extend from a Y-shaped connection with said second restraint line and the rear end of said safety liens are laterally spaced and attached to said primary frame assembly.

* * * * *